US008272150B2

(12) United States Patent
Bryne

(10) Patent No.: US 8,272,150 B2
(45) Date of Patent: Sep. 25, 2012

(54) SHOE SOLE MOUNTING STANDARD FOR BICYCLE CLEAT

(75) Inventor: Richard M. Bryne, San Diego, CA (US)

(73) Assignee: Speedplay, Inc., Del Mar, CA (US)

( * ) Notice: Subject to any disclaimer, the term of this patent is extended or adjusted under 35 U.S.C. 154(b) by 619 days.

(21) Appl. No.: 12/334,402

(22) Filed: Dec. 12, 2008

(65) Prior Publication Data

US 2010/0146821 A1 Jun. 17, 2010

(51) Int. Cl.
*A43B 5/14* (2006.01)

(52) U.S. Cl. ..... 36/131

(58) Field of Classification Search ..... 36/131, 36/134; 74/594.6

See application file for complete search history.

(56) References Cited

U.S. PATENT DOCUMENTS

| | | | | | |
|---|---|---|---|---|---|
| 4,377,952 | A | * | 3/1983 | Gamondes | 74/594.6 |
| 4,506,463 | A | * | 3/1985 | Chassaing | 36/131 |
| 4,686,867 | A | * | 8/1987 | Bernard et al. | 74/594.6 |
| 4,942,778 | A | | 7/1990 | Bryne | |
| 5,079,968 | A | * | 1/1992 | Starner | 74/594.6 |
| 5,199,192 | A | * | 4/1993 | Kilgore et al. | 36/131 |
| 5,213,009 | A | | 5/1993 | Bryne | |
| 5,325,738 | A | | 7/1994 | Bryne | |
| 5,546,829 | A | | 8/1996 | Bryne | |
| 5,606,894 | A | | 3/1997 | Bryne | |
| 5,657,558 | A | | 8/1997 | Pohu | |
| 5,685,093 | A | | 11/1997 | Lin | |
| 5,687,619 | A | | 11/1997 | Bryne | |
| 5,727,429 | A | | 3/1998 | Ueda | |
| 5,862,716 | A | | 1/1999 | Bryne | |
| 5,943,795 | A | * | 8/1999 | Ueda et al. | 36/131 |
| 6,244,136 | B1 | | 6/2001 | Chen | |
| 6,494,117 | B1 | | 12/2002 | Bryne | |
| 7,017,445 | B2 | * | 3/2006 | Bryne | 74/594.6 |
| 2001/0008093 | A1 | | 7/2001 | Heim | |
| 2007/0084086 | A1 | | 4/2007 | Bryne | |
| 2008/0110294 | A1 | | 5/2008 | Bryne | |

FOREIGN PATENT DOCUMENTS

| | | |
|---|---|---|
| EP | 0153210 | 8/1985 |
| EP | 0293340 | 11/1988 |
| EP | 0826588 | 3/1998 |
| FR | 2521837 | 8/1983 |
| FR | 2775424 | 9/1999 |
| JP | 05111402 | 5/1993 |
| TW | 200303278 | 9/2003 |

* cited by examiner

*Primary Examiner* — Ted Kavanaugh
(74) *Attorney, Agent, or Firm* — Sheppard, Mullin, Richter & Hampton LLP

(57) ABSTRACT

The present invention is embodied in a mounting standard for mounting a cleat assembly to a shoe sole having a curved underside portion and a plurality of mounting holes. The mounting standard is configured so that the cleat assembly can be moved forward or rearward with respect to the curved underside portion of the shoe sole without significantly affecting the distance between the cleat assembly and a user's foot. The present invention is also embodied in a shoe configured to receive a user's foot, the shoe comprising a shoe sole and a mounting standard.

35 Claims, 6 Drawing Sheets

SHOE SOLE MOUNTING STANDARD FOR BICYCLE CLEAT

BACKGROUND OF THE INVENTION

This invention relates generally to cleat assemblies configured for releasable securement to pedals for bicycles and the like, and, more particularly, to a shoe sole mounting standard for use with such cleat assemblies.

Cleat assemblies of this particular kind typically include a spring housing and an overlaying bottom plate configured to be attached to the sole of a user's shoe. The spring housing and bottom plate, together, define a central opening sized and configured to conformably receive a pedal. The spring housing supports one or more spring clips adjacent to the central opening, for engaging and releasably retaining the pedal.

In the past, shoe soles for use with cleat assemblies of this particular kind typically included either a three-hole or four-hole mounting standard for mounting the cleat assembly onto the shoe sole. The three-hole mounting standard was curved from front to back, following the typical curvature of a shoe sole. One of the mounting holes was positioned at a forward end of the mounting standard. The other two mounting holes were positioned at a rearward end of the mounting standard.

A problem with the curved, three-hole mounting standard was that the three cleat mounting holes were poorly placed relative to the axis of the pedal. The poor placement of the mounting holes and the curvature of the mounting standard required the use of a thick adapter plate to accommodate certain cleat assemblies, such as the cleat assemblies disclosed in U.S. Patent Application Publication No. 2008/0110294. The thick adapter plate, positioned between the mounting standard and the cleat assembly, added weight to the user's shoe and prevented the pedal from being positioned as close as possible to the shoe sole. As a result, the three-hole mounting standard was not an optimal design for power transfer from the user's foot to the pedal.

The four-hole mounting standard had a planar cleat contact area and an internal four-hole fastening plate for fastening the cleat assembly onto the shoe sole. The mounting holes in the shoe sole were configured as elongated slots extending lengthwise on a portion of the sole. The internal four-hole fastening plate was a one-piece steel backing plate inside the shoe having four threaded holes to receive the four screws that attached the cleat assembly to the shoe sole. The elongated mounting holes in the shoe sole allowed the user to adjust the internal four-hole fastening plate (and thus the cleat assembly itself) forward and rearward with respect to the shoe sole.

The pedal thus contacted an area centered or "nesting" within the four-hole pattern. Hence, the mounting hardware of the four-hole design was more optimally positioned "out of the way," in front of and behind the pedal, rather than above it. The four-hole design allowed the cleat to be positioned closer to the foot, because the mounting hardware was not in the way.

A problem with the four-hole mounting standard was that, because the support surface on the shoe sole for the cleat assembly was planar, the distance between the cleat assembly and the user's foot increased as the cleat assembly was moved forward or rearward with respect to the center of the mounting standard. This increased the distance between the pedal and the user's foot. As the distance between the foot and the pedal increased, power transmission from the foot to the pedal suffered. The increased distance also made the cleat "taller" and harder to walk on. Additionally, because the internal four-hole fastening plate was a single piece of metal and was limited in movement to the forward and rearward directions, the cleat assembly could not be pivoted with respect to the shoe sole for rotational adjustment.

It should be appreciated from the foregoing description that there is a need for an improved mounting standard that overcomes the drawbacks discussed above. Specifically, there is a need for a mounting standard that avoids the need to use a thick adapter plate that increases the distance between the user's foot and the pedal. Further, there is a need for a mounting standard that avoids the problem whereby the distance between the cleat assembly and the user's foot is increased as the cleat assembly is moved forward or rearward with respect to the center of the mounting standard. Further, there is a need for a mounting standard that allows the cleat assembly to be pivoted with respect to the shoe sole. The present invention satisfies these needs and provides further related advantages.

SUMMARY OF THE INVENTION

The present invention is embodied in a mounting standard for mounting a cleat assembly to a shoe sole having a curved underside portion and a plurality of mounting holes. The mounting standard is configured so that the cleat assembly can be moved forward or rearward with respect to the curved underside portion of the shoe sole without significantly affecting the distance between the cleat assembly and a user's foot.

In one embodiment, the mounting standard comprises a contoured shim and a plurality of internal nut assemblies. The contoured shim has a curved top surface shaped generally to follow the curved underside portion of the shoe sole, a substantially flat bottom surface, and a plurality of shim holes configured for alignment with the plurality of mounting holes. Each of the plurality of internal nut assemblies has a nut protruding therefrom for receiving a threaded fastener. The mounting standard is configured so that the cleat assembly and contoured shim can be secured to the curved underside portion of the shoe sole using a single set of threaded fasteners, each threaded fastener mating with a nut protruding from one of the plurality of internal nut assemblies, through one of the plurality of mounting holes, and into one of the plurality of shim holes.

In one embodiment, the plurality of shim holes includes four shim holes. Two of the shim holes are positioned in proximity to a forward end of the contoured shim. Two of the shim holes are positioned in proximity to a rearward end of the contoured shim. Each of the plurality of shim holes is configured as an elongated slot extending widthwise on a portion of the contoured shim.

In one embodiment, each of the plurality of internal nut assemblies has two nuts protruding therefrom and a substantially flat bar connecting the two nuts. Because there are a plurality of internal nut assemblies, the mounting standard is configured to accommodate at least a slight amount of rotational adjustment of the cleat assembly with respect to the shoe sole.

The present invention is also embodied in a shoe configured to receive a user's foot, the shoe comprising a shoe sole and a mounting standard. The shoe sole has a curved underside portion and a plurality of mounting holes. The mounting standard is secured to the curved underside portion of the shoe sole for mounting a cleat assembly to the shoe sole. The mounting standard comprises a contoured shim and a plurality of internal nut assemblies. The contoured shim has a curved top surface shaped generally to follow the curved underside portion of the shoe sole, a substantially flat bottom surface, and a plurality of shim holes configured for alignment with the plurality of mounting holes. Each of the plurality of internal nut assemblies has a nut protruding therefrom for receiving a threaded fastener. The mounting standard is configured so that the contoured shim can be moved forward or rearward with respect to the curved underside portion of the shoe sole without significantly affecting the distance between the contoured shim and the user's foot.

In one embodiment, the plurality of mounting holes includes four mounting holes. Each of the plurality of mounting holes is configured as an elongated slot extending lengthwise on the curved underside portion of the shoe sole.

In one embodiment, the shoe sole further has a plurality of channels formed in a top portion of the shoe sole and extending lengthwise on the top portion of the shoe sole. Each of the plurality of channels is configured to receive one of the plurality of internal nut assemblies.

Other features and advantages of the present invention should become apparent from the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
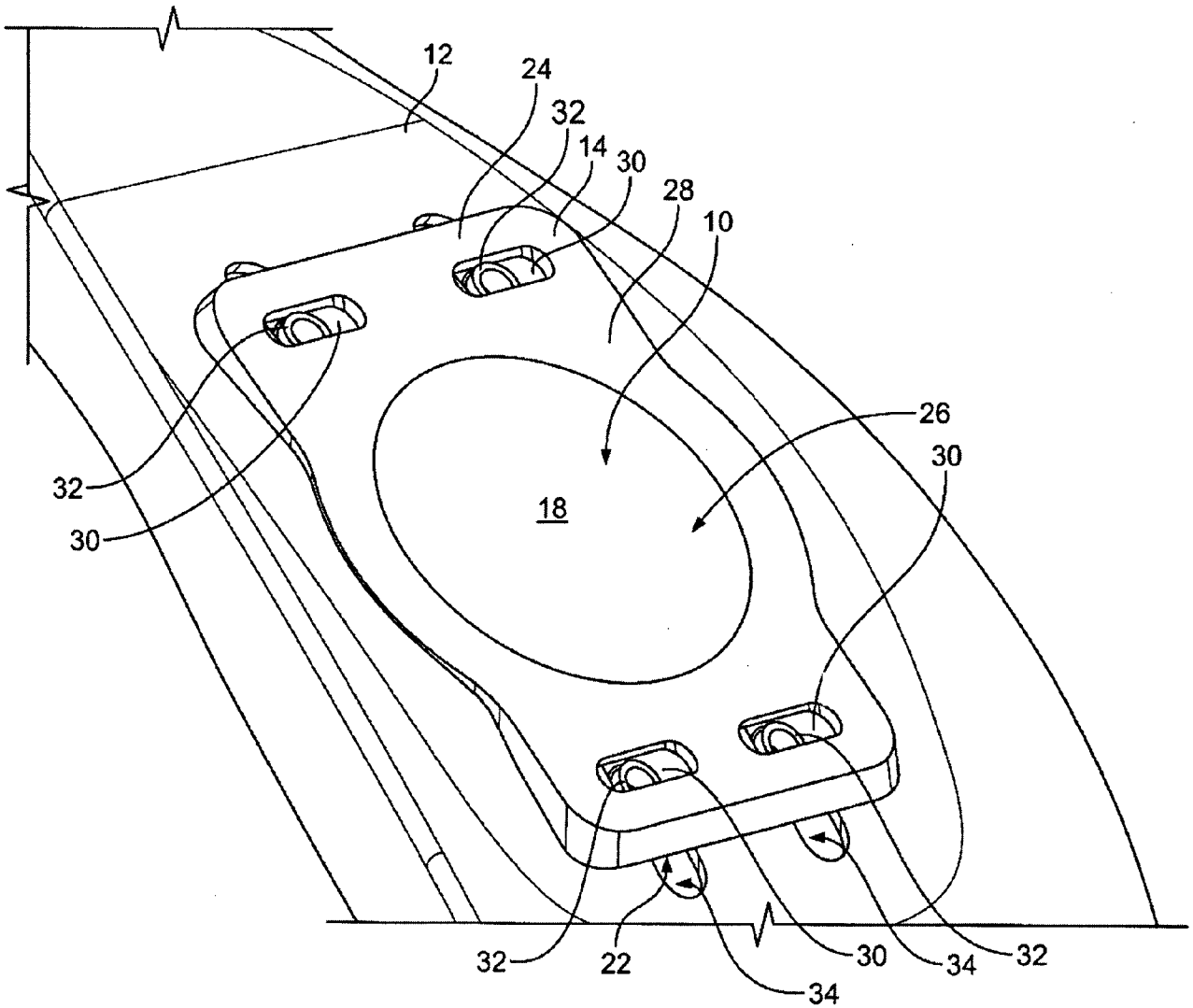
FIG. 1 is a perspective view of a mounting standard in accordance with an embodiment of the present invention, the mounting standard positioned on the underside of a curved shoe sole.

With reference to FIG. 1, there is shown a perspective view of a mounting standard 10 in accordance with an embodiment of the present invention, the mounting standard positioned on the underside of a curved shoe sole 12. The particular mounting standard and shoe sole depicted are configured for a user's right shoe, but it will be appreciated that a similar mounting standard and shoe sole could be oppositely configured for the user's left shoe. The mounting standard comprises a contoured shim 14 positioned on the underside of the shoe sole and a pair of internal nut assemblies 16 positioned within or atop the shoe sole.

The contoured shim 14 has a flat bottom surface 18 for mounting a cleat assembly and a curved top surface 20 shaped to follow the curvature of the underside of the shoe sole 12. Because the contoured shim has a flat bottom surface and a curved top surface, the contoured shim allows a flat cleat assembly to fit a curved shoe sole and to be moved forward or rearward with respect to the shoe sole without significantly affecting the distance between the cleat assembly and a user's foot.

The contoured shim 14 is thickest at its forward end 22 and rearward end 24. Moving away from the forward end or rearward end, the contoured shim gets progressively thinner. At the midpoint between the forward end and the rearward end, the contoured shim is as thin as the material or materials comprising the contoured shim will allow, while still withstanding the stresses imposed upon the contoured shim during installation and use. In one embodiment, the contoured shim is approximately 0.02 inches thick at the midpoint between the forward end and the rearward end.

In one embodiment, the contoured shim 14 comprises a thin metal center plate 26 surrounded at its edges by a plastic structure 28 having a flat bottom surface for mounting a cleat assembly and a curved top surface shaped to follow the curvature of the underside of the shoe sole 12. The center plate may be positioned within a circular hole formed in the center of the plastic structure. Stainless steel shim stock is preferably used for the center plate, as stainless steel generally offers better wear resistance than plastic for the contoured shim's main contact area with the pedal.

Positioned in the plastic structure in proximity to the forward end 22 of the contoured shim 14 are two shim holes 30 configured as elongated slots extending widthwise on a portion of the contoured shim. Positioned in proximity to the rearward end 24 of the contoured shim are two more shim holes 30 also configured as elongated slots extending widthwise on a portion of the contoured shim. Each shim hole 30 is configured to receive a nut 32 protruding from one of the pair of internal nut assemblies 16. Each nut extends through a mounting hole 34 in the shoe sole 12. Because the shim holes 30 are elongated, the contoured shim may be adjusted sideways with respect to the shoe sole, thus allowing a cleat assembly to be adjusted sideways with respect to the shoe sole.

Figure 2:
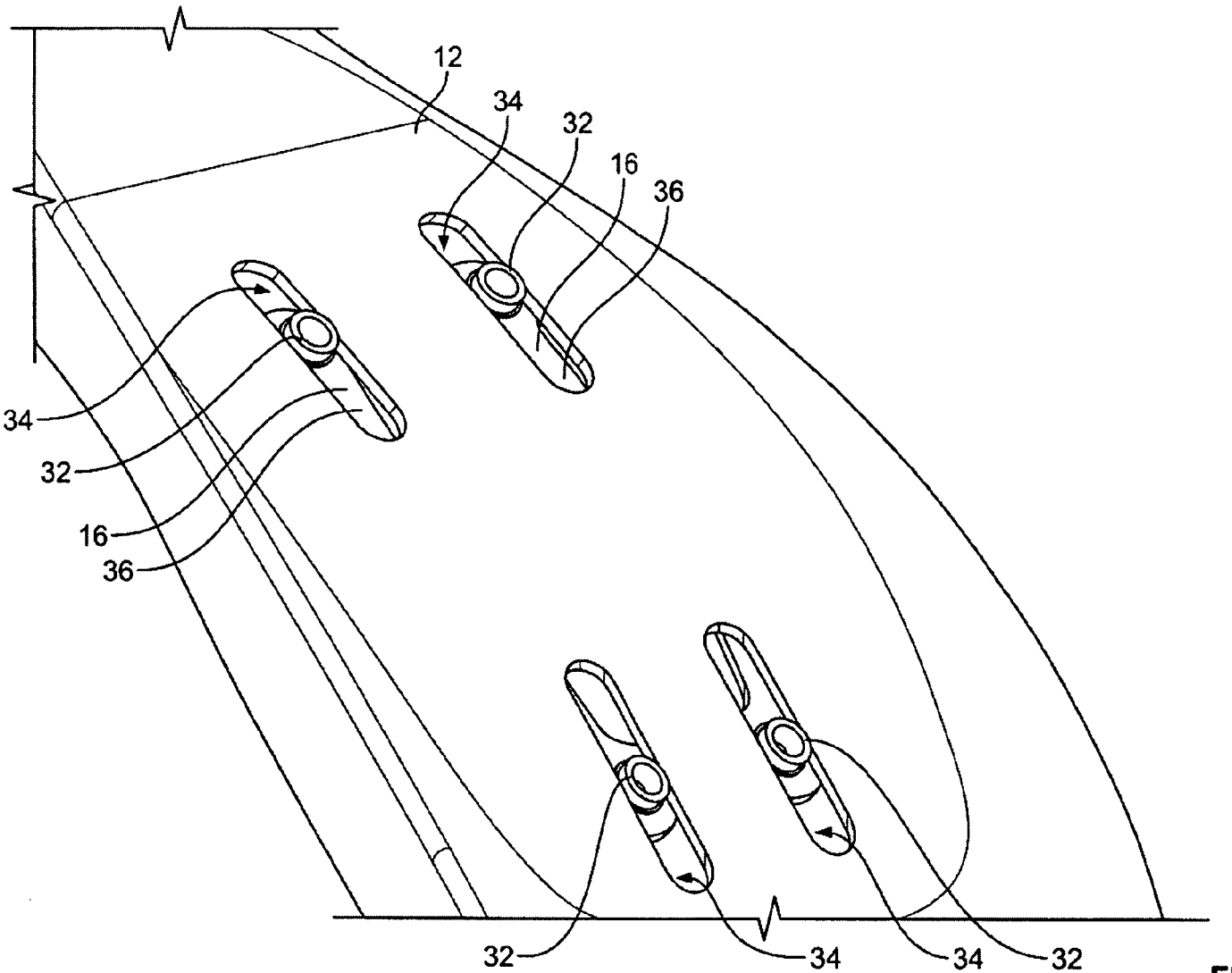
FIG. 2 is a perspective view of the shoe sole and a pair of internal nut assemblies in accordance with an embodiment of the present invention.

With reference to FIG. 2, there is shown a perspective view of the curved shoe sole 12 and pair of internal nut assemblies 16 without the contoured shim 14, the nuts 32 of the internal nut assemblies extending through the mounting holes 34 in the shoe sole. As shown in FIG. 2, the shoe sole has four mounting holes 34, each of which is configured as an elongated slot extending lengthwise on a portion of the shoe sole. Because the mounting holes 34 are elongated, the internal nut assemblies may be moved forward or rearward with respect to the shoe sole, thus allowing a cleat assembly to be moved forward or rearward with respect to the shoe sole. The fore-aft adjustment is independent from the side-to-side adjustment described above, making adjustment of the cleat assembly relatively easy. Because the shoe sole is curved, the mounting holes 34 can be made longer than mounting holes in prior art four-hole mounting standards, without increasing the thickness of the shoe sole.

Figure 3:
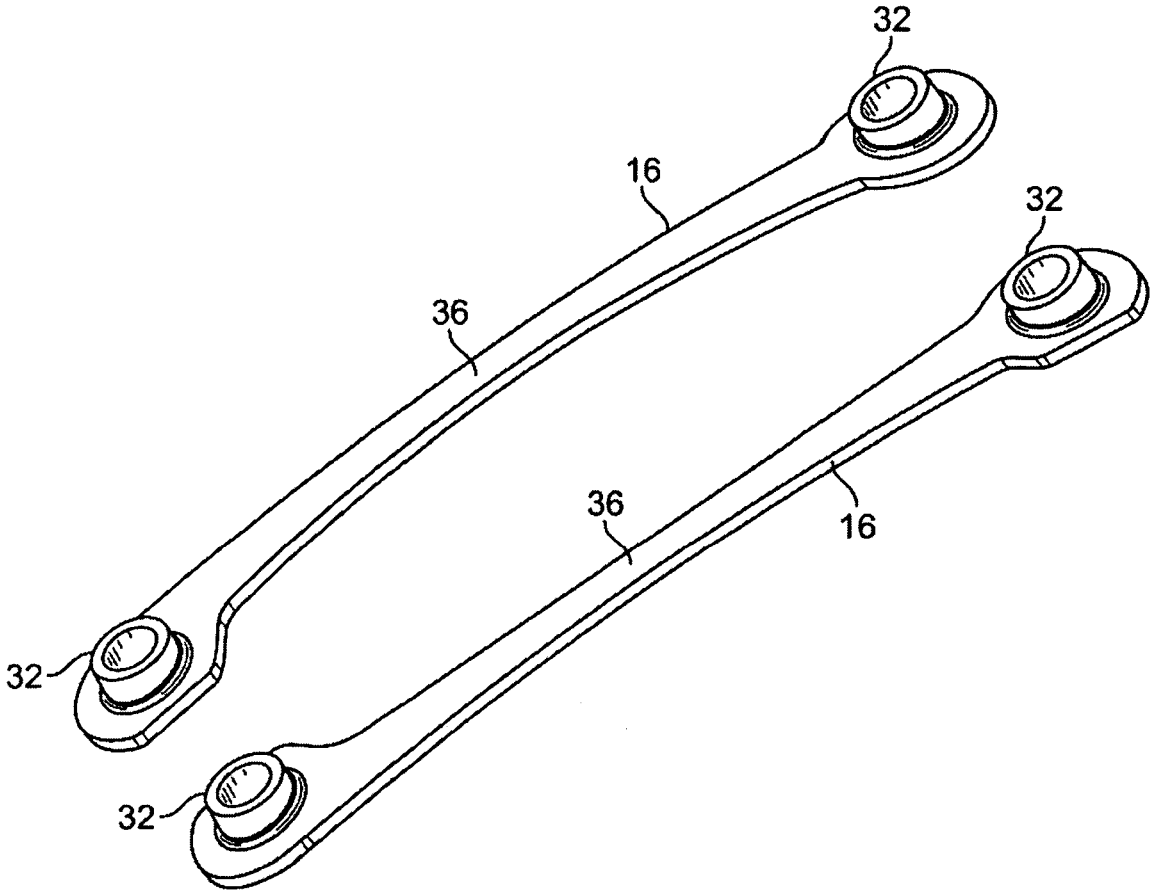
FIG. 3 is a perspective view of the pair of internal nut assemblies, in accordance with an embodiment of the present invention.

With reference to FIG. 3, there is shown a perspective view of the pair of internal nut assemblies 16, in accordance with an embodiment of the present invention. Each internal nut assembly comprises two nuts 32 connected by a flat bar 36. Each nut 32 is threaded and configured to receive a screw used to mount a cleat assembly onto the shoe sole 12. Once a screw has been received within one of the nuts, the nut at the other end of the flat bar is automatically aligned for easier installation than if four individual fasteners were used. Because the internal nut assemblies are two independent pieces rather than one piece, the internal nut assemblies accommodate a slight amount of rotational adjustment in either direction of a cleat assembly with respect to the shoe sole 12. Configuring the internal nut assemblies as two independent pieces rather than as a one-piece backing plate also requires less material, saving on weight.

Figure 4:
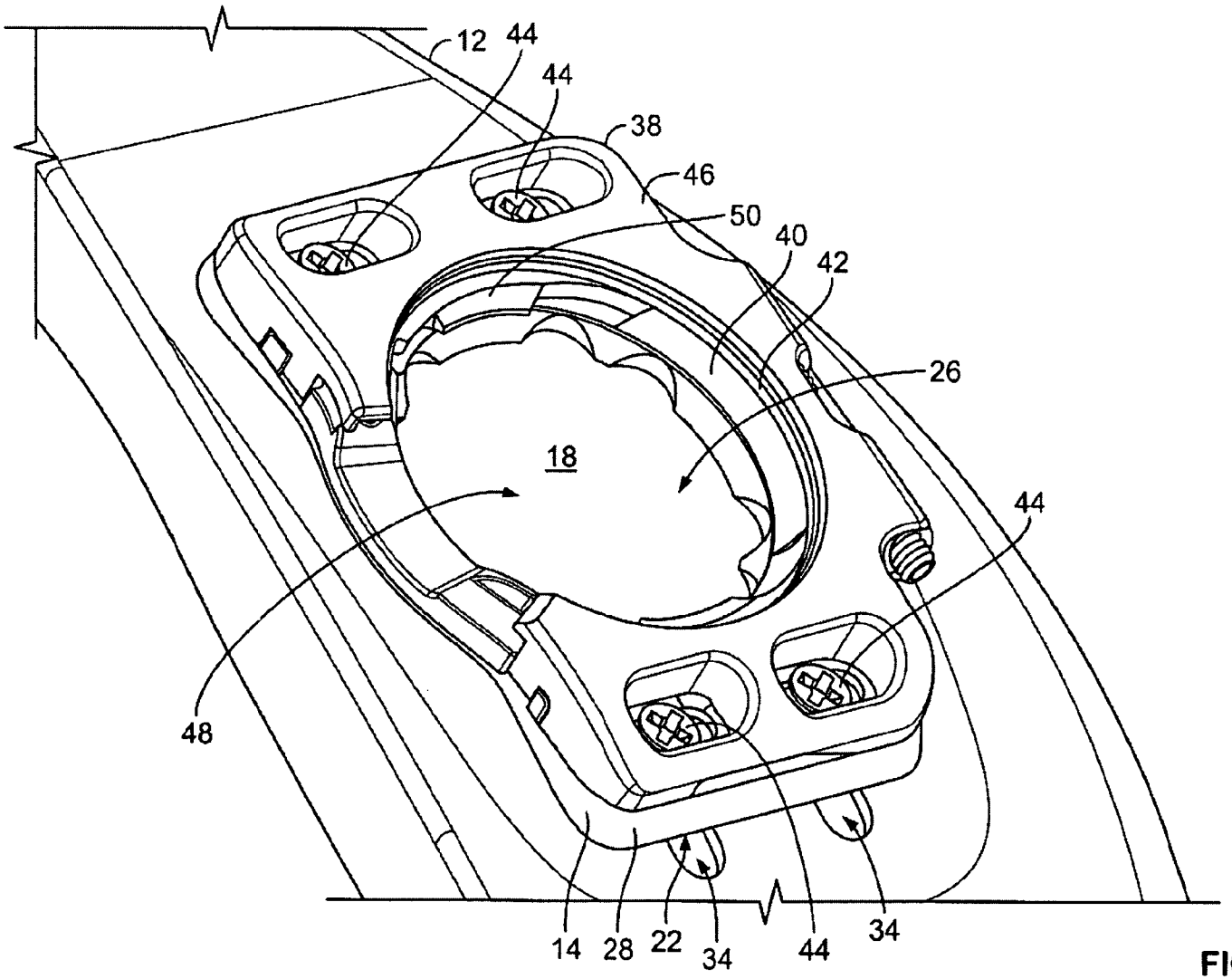
FIG. 4 is a perspective view of the mounting standard and cleat assembly, in accordance with an embodiment of the present invention, the mounting standard positioned on the underside of the curved shoe sole and the cleat assembly mounted thereon.

With reference to FIG. 4 there is shown a perspective view of the mounting standard 10 and a cleat assembly 38, in accordance with an embodiment of the present invention, the mounting standard positioned on the underside of the curved shoe sole 12 and the cleat assembly mounted thereon. The particular cleat assembly depicted is configured for attachment to the user's right shoe, but it will be appreciated that a similar cleat assembly could be oppositely configured for attachment to the user's left shoe. The cleat assembly includes a plastic spring housing 40 and a steel bottom plate 42 configured to be secured, together, by four screws 44 to the mounting standard. An elastomeric cap 46 overlays the bottom plate. The spring housing and bottom plate, together, define a circular central opening 48 sized and shaped to conformably receive a pedal (not shown). A spring clip 50 is mounted between the spring housing and the bottom plate for releasably engaging the pedal when the cleat assembly is positioned over the pedal.

Figure 5:
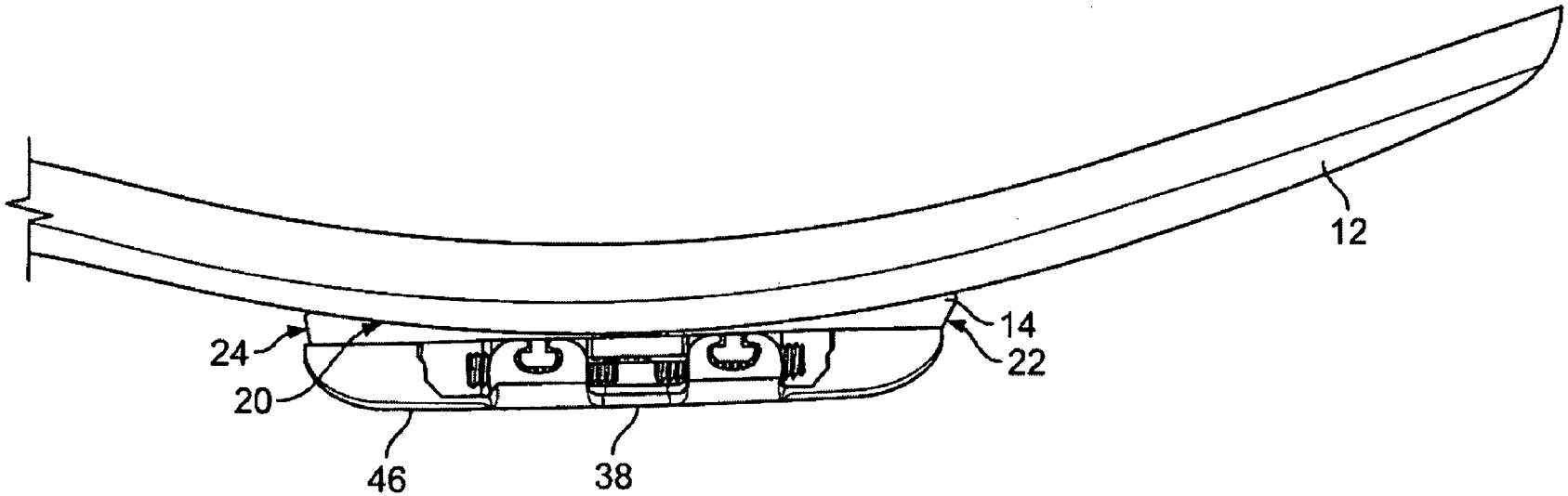
FIG. 5 is a right elevational view of the mounting standard and cleat assembly, in accordance with an embodiment of the present invention, the mounting standard positioned on the underside of the curved shoe sole and the cleat assembly mounted thereon.

With reference to FIG. 5, there is shown a right elevational view of the mounting standard 10 and cleat assembly 38, in accordance with an embodiment of the present invention, the mounting standard positioned on the underside of the curved shoe sole 12 and the cleat assembly mounted thereon. As shown in FIG. 5, the contoured shim 14 is thickest at the forward end 22 and rearward end 24, and thinnest at the midpoint between the forward end and the rearward end. Because the contoured shim does not require its own set of screws or other fasteners separate from the screws 44 that secure the cleat assembly to the pair of internal nut assemblies 16, the contoured shim can be made significantly thinner and lighter than the thick adapter plates used with prior art three-hole mounting standards. Also, because the underside of the shoe sole is curved and not planar, the distance between the cleat assembly and the user's foot is not significantly affected as the cleat assembly is moved forward or rearward with respect to the shoe sole, unlike the situation with prior art four-hole mounting standards.

Using the present invention, the user's foot is positioned significantly closer to the cleat assembly 38 than was the case using the prior art three-hole and four-hole mounting standards. This close positioning improves pedaling feel and power transfer, and makes the combination of the pedal and user's shoe more aerodynamic. Also, by positioning the user's foot significantly closer to the cleat assembly, the present invention makes walking in a cleated cycling shoe easier. Additionally, by combining a four-hole mounting standard with the curved shoe sole 12, the cleat assembly is able to follow the general contour of the user's foot as the cleat assembly is moved forward or rearward with respect to the shoe sole. This feature assists in maintaining an optimal foot-to-pedal distance as the cleat assembly is moved forward or rearward. Furthermore, unlike the prior art mounting standards, the internal nut assemblies 16 can accommodate a slight amount of rotational adjustment of the cleat assembly with respect to the shoe sole.

Figure 6:
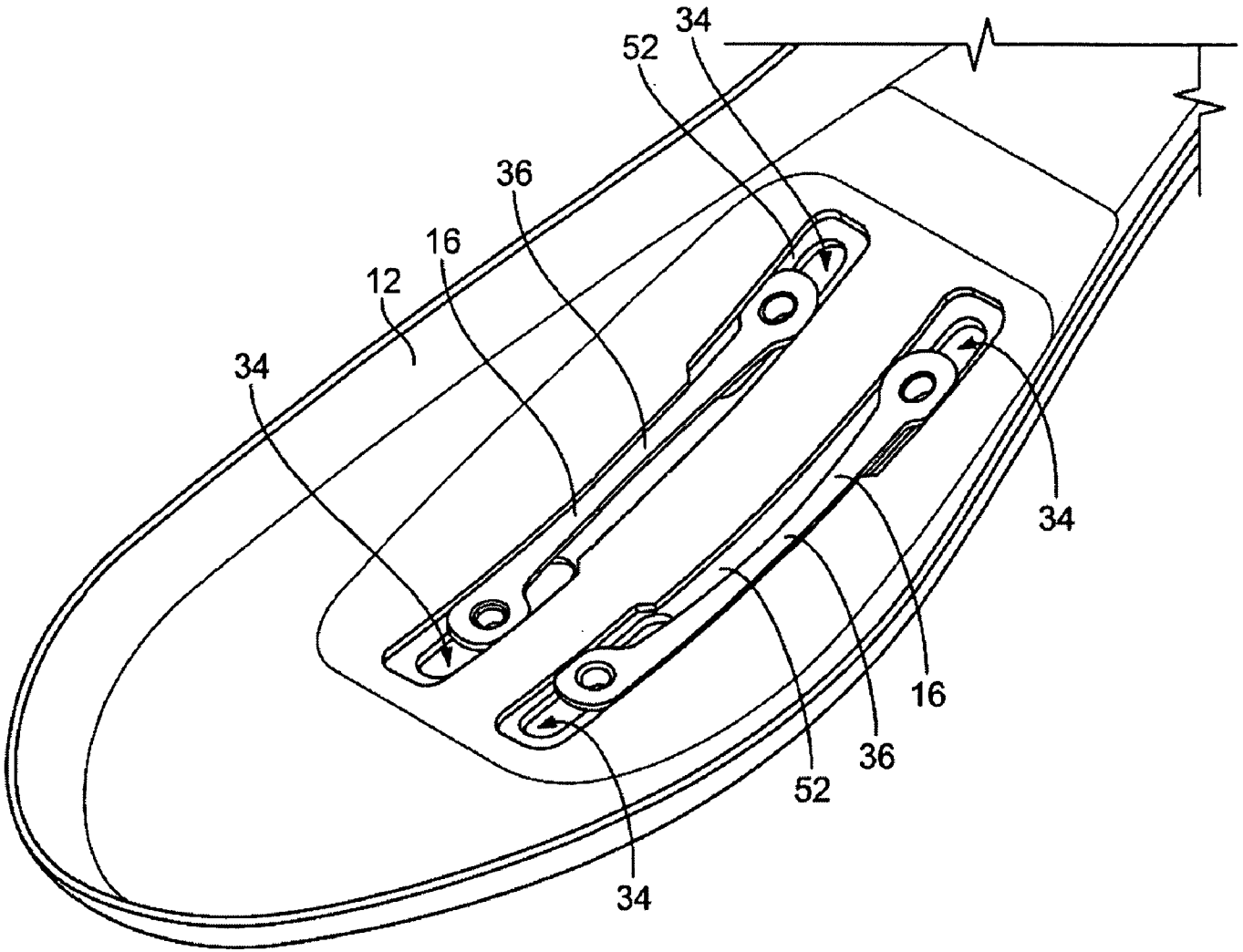
FIG. 6 is a perspective view of the top side of the shoe sole and pair of internal nut assemblies in accordance with an embodiment of the present invention.

With reference to FIG. 6, there is shown a perspective view of the top side of the curved shoe sole 12 and a pair of internal nut assemblies 16, the nuts 32 of the internal nut assemblies extending through the mounting holes 34 in the shoe sole. As shown in FIG. 6, each internal nut assembly acts like a spanner wrench inside the shoe, once one of the nuts 32 is in place within one of the mounting holes. In other words, when a user tightens or loosens a screw 44 into or out of a nut 32, the internal nut assembly acts as a rotation stabilizer due to its long "dogbone" shape, inhibiting the nut from spinning inside the shoe sole.

Also shown in FIG. 6 are a pair of channels 52 formed in the top side of the shoe sole 12 and extending lengthwise along the shoe sole. Each channel encompasses two of the mounting holes 34 in the shoe sole and is configured to receive one of the internal nut assemblies 16. Embedding the internal nut assemblies in the channels reduces the distance from the user's foot to the bottom of the shoe sole. The channels also inhibit the internal nut assemblies from spinning inside the shoe when a user tightens or loosens a screw 44 into or out of a nut 32.

Although the invention has been described in detail with reference only to the presently preferred embodiments, those skilled in the art will appreciate that various modifications can be made without departing from the invention. Accordingly, the invention is defined only by the following claims.

What is claimed is:

1. A mounting standard for mounting a cleat assembly to a shoe sole having a curved underside portion and a plurality of mounting holes, the mounting standard comprising:

a contoured shim having a curved top surface shaped generally to follow the curved underside portion of the shoe sole, a substantially flat bottom surface, and a plurality of shim holes configured for alignment with the plurality of mounting holes; and a plurality of internal nut assemblies, each having two nuts protruding therefrom and a bar connecting the two nuts;

wherein the mounting standard is configured so that the cleat assembly and contoured shim can be secured to the curved underside portion of the shoe sole using a single set of threaded fasteners, each threaded fastener mating with a nut protruding from one of the plurality of internal nut assemblies, through one of the plurality of mounting holes, and into one of the plurality of shim holes.

2. The mounting standard of claim 1, wherein the plurality of shim holes includes four shim holes.

3. The mounting standard of claim 2, wherein:

two of the shim holes are positioned in proximity to a forward end of the contoured shim; and two of the shim holes are positioned in proximity to a rearward end of the contoured shim.

4. The mounting standard of claim 1, wherein each of the plurality of shim holes is configured as an elongated slot extending widthwise on a portion of the contoured shim.

5. The mounting standard of claim 1, wherein the bar is substantially flat.

6. The mounting standard of claim 1, wherein the mounting standard is configured to accommodate at least a slight amount of rotational adjustment of the cleat assembly with respect to the shoe sole.

7. A mounting standard for mounting a cleat assembly to the sole of a shoe, the shoe sole having a curved underside portion and a plurality of mounting holes, and the shoe configured to receive a user's foot, the mounting standard comprising:

a contoured shim having a curved top surface shaped generally to follow the curved underside portion of the shoe sole, a substantially flat bottom surface, and a plurality of shim holes configured for alignment with the plurality of mounting holes; and a plurality of internal nut assemblies, each having two nuts protruding therefrom and a bar connecting the two nuts;

wherein the mounting standard is configured so that the contoured shim can be moved forward or rearward with respect to the curved underside portion of the shoe sole without significantly affecting the distance between the contoured shim and the user's foot.

8. The mounting standard of claim 7, wherein the plurality of shim holes includes four shim holes.

9. The mounting standard of claim 8, wherein:

two of the shim holes are positioned in proximity to a forward end of the contoured shim; and two of the shim holes are positioned in proximity to a rearward end of the contoured shim.

10. The mounting standard of claim 7, wherein each of the plurality of shim holes is configured as an elongated slot extending widthwise on a portion of the contoured shim.

11. The mounting standard of claim 7, wherein the bar is substantially flat.

12. The mounting standard of claim 7, wherein the mounting standard is configured to accommodate at least a slight amount of rotational adjustment of the cleat assembly with respect to the shoe sole.

13. The mounting standard of claim 7, wherein the mounting standard is configured so that the cleat assembly and contoured shim can be secured to the curved underside portion of the shoe sole using a single set of threaded fasteners, each threaded fastener mating with a nut protruding from one of the plurality of internal nut assemblies, through one of the plurality of mounting holes, and into one of the plurality of shim holes.

14. A shoe configured to receive a user's foot, the shoe comprising:

a shoe sole having a curved underside portion, and a plurality of mounting holes; and a mounting standard secured to the curved underside portion of the shoe sole for mounting a cleat assembly to the shoe sole, the mounting standard comprising a contoured shim having a curved top surface shaped generally to follow the curved underside portion of the shoe sole, a substantially flat bottom surface, and a plurality of shim holes configured for alignment with the plurality of mounting holes, and a plurality of internal nut assemblies, each having a nut protruding therefrom for receiving a threaded fastener;

wherein the mounting standard is configured so that the contoured shim can be moved forward or rearward with respect to the curved underside portion of the shoe sole without significantly affecting the distance between the contoured shim and the user's foot.

15. The shoe of claim 14, wherein the mounting standard is configured to accommodate at least a slight amount of rotational adjustment of the cleat assembly with respect to the shoe sole.

16. The shoe of claim 14, wherein the mounting standard is configured so that the cleat assembly and contoured shim can be secured to the curved underside portion of the shoe sole using a single set of threaded fasteners, each threaded fastener mating with a nut protruding from one of the plurality of internal nut assemblies, through one of the plurality of mounting holes, and into one of the plurality of shim holes.

17. The shoe of claim 14, wherein:

the shoe sole further has a plurality of channels formed in a top portion of the shoe sole and extending lengthwise on the top portion of the shoe sole; and each of the plurality of channels is configured to receive one of the plurality of internal nut assemblies.

18. The shoe of claim 14, wherein:

the plurality of shim holes includes four shim holes; and the plurality of mounting holes includes four mounting holes.

19. The shoe of claim 18, wherein:

two of the shim holes are positioned in proximity to a forward end of the contoured shim; and two of the shim holes are positioned in proximity to a rearward end of the contoured shim.

20. The shoe of claim 14, wherein each of the plurality of shim holes is configured as an elongated slot extending widthwise on a portion of the contoured shim.

21. The shoe of claim 14, wherein each of the plurality of mounting holes is configured as an elongated slot extending lengthwise on the curved underside portion of the shoe sole.

22. The shoe of claim 14, wherein each of the plurality of internal nut assemblies has two nuts protruding therefrom.

23. The shoe of claim 22, wherein each of the plurality of internal nut assemblies further comprises a substantially flat bar connecting the two nuts.

24. The shoe of claim 22, wherein each of the plurality of internal nut assemblies further comprises a bar connecting the two nuts.

25. A cleat assembly mounting system comprising:

a shoe sole having a curved underside portion, and a plurality of mounting holes;

a shim configured to be secured to the curved underside portion of the shoe sole for mounting a cleat assembly to the shoe sole, the shim having a plurality of shim holes configured for alignment with the plurality of mounting holes; and a plurality of nut assemblies, each having a nut for securing the shim to the curved underside portion of the shoe sole using a set of threaded fasteners;

wherein each of the plurality of mounting holes is configured as a slot extending in a first direction on the curved underside portion of the shoe sole;

wherein each of the plurality of shim holes is configured as a slot extending in a second direction on a portion of the shim; and wherein the second direction is substantially orthogonal to the first direction.

26. The cleat assembly mounting system of claim 25, wherein the shim is a contoured shim further having:

a curved top surface shaped generally to follow the curved underside portion of the shoe sole; and a substantially flat bottom surface.

27. The cleat assembly mounting system of claim 25, wherein:

each of the plurality of nut assemblies has two nuts for securing the shim to the curved underside portion of the shoe sole; and each of the plurality of nut assemblies further has a bar connecting the two nuts.

28. A mounting standard for mounting a cleat assembly to a shoe sole having a curved underside portion and a plurality of mounting slots extending in a lengthwise direction on the shoe sole, the mounting standard comprising:

a shim having a plurality of shim holes configured for alignment with the plurality of mounting slots; and a plurality of nut assemblies, each having a nut for securing the shim to the curved underside portion of the shoe sole using a set of threaded fasteners;

wherein each of the plurality of shim holes is configured as a slot extending in a widthwise direction on a portion of the shim;

wherein each of the plurality of nut assemblies has two nuts for securing the shim to the curved underside portion of the shoe sole; and each of the plurality of nut assemblies further has a bar connecting the two nuts.

29. The mounting standard of claim 28, wherein the shim is a contoured shim further having:

a curved top surface shaped generally to follow the curved underside portion of the shoe sole; and a substantially flat bottom surface.

30. A cleat assembly mounting system comprising:

a shoe sole having a curved underside portion, and a plurality of mounting holes;

a shim configured to be secured to the curved underside portion of the shoe sole for mounting a cleat assembly to the shoe sole, the shim having a plurality of shim holes configured for alignment with the plurality of mounting holes; and a plurality of nut assemblies, each comprising two nuts for securing the shim to the curved underside portion of the shoe sole using a set of threaded fasteners; and a bar connecting the two nuts.

31. The cleat assembly mounting system of claim 30, wherein the shim is a contoured shim further having:

a curved top surface shaped generally to follow the curved underside portion of the shoe sole; and a substantially flat bottom surface.

32. The cleat assembly mounting system of claim 30, wherein:

each of the plurality of mounting holes is configured as a slot extending in a first direction on the curved underside portion of the shoe sole;

each of the plurality of shim holes is configured as a slot extending in a second direction on a portion of the shim; and the second direction is substantially orthogonal to the first direction.

33. A mounting standard for mounting a cleat assembly to a shoe sole having a curved underside portion and a plurality of mounting holes, the mounting standard comprising:

a shim having a plurality of shim holes configured for alignment with the plurality of mounting holes; and a plurality of nut assemblies, each comprising two nuts for securing the shim to the curved underside portion of the shoe sole using a set of threaded fasteners; and a bar connecting the two nuts.

34. The mounting standard of claim 33, wherein the shim is a contoured shim further having:

a curved top surface shaped generally to follow the curved underside portion of the shoe sole; and a substantially flat bottom surface.

35. The cleat assembly mounting system of claim 33, wherein each of the plurality of shim holes is configured as a slot extending in a direction on a portion of the shim that is substantially orthogonal to a direction in which each of the plurality of mounting holes extends on the curved underside portion of the shoe sole.

* * * * *